US006002985A

United States Patent [19]

Stephenson

[11] Patent Number: 6,002,985

[45] Date of Patent: Dec. 14, 1999

[54] METHOD OF CONTROLLING DEVELOPMENT OF AN OIL OR GAS RESERVOIR

[75] Inventor: Stanley V. Stephenson, Duncan, Okla.

[73] Assignee: Halliburton Energy Services, Inc., Duncan, Okla.

[21] Appl. No.: 08/851,919

[22] Filed: May 6, 1997

[51] Int. Cl.[6] ..... G06F 19/00

[52] U.S. Cl. ..... 702/13; 706/929

[58] Field of Search ..... 702/9, 12, 13, 702/11, 6, 7; 706/929, 928

[56] References Cited

U.S. PATENT DOCUMENTS 5,251,286 10/1993 Wiener et al. ..... 702/12
5,444,619 8/1995 Hoskins et al. ..... 702/13

OTHER PUBLICATIONS

D. S. McVey, Shahab Mohaghegh, and Khashayar Aminian: "Identification of Parameters Influencing the Response of Gas Storage Wells to Hydraulic Fracturing With the Aid of a Neural Network," Society of Petroleum Engineers Paper No. 29159, Eastern Regional Conference & Exhibition, Charleston, WV (Nov. 1994).

Mohaghegh, S., and Ameri, S.: "Artificial Neural Network As A Valuable Tool For Petroleum Engineers," Society of Petroleum Engineers Paper No. 29220 (1995).

A. C. White, D. Molnar, K. Aminian, S. Mohaghegh, S. Ameri, P. Esposito: "The Application of ANN for Zone Identification in a Complex Reservoir," Society of Petroleum Engineers Paper No. 30977, SPE Eastern Regional Conference & Exhibition, Morgantown, WV (Sep. 1995).

Mohaghegh, S., Aminian, K., Ameri, S., and McVey, D.; "Predicting Well Stimulation Results in a Gas Storage Field in the Absence of Reservoir Data, Using Neural Networks," Society of Petroleum Engineers Paper No. 31159 (1995).

Mohaghegh, S., Balan, B., Ameri, S., and McVey, D. S.: "A Hybrid, Neuro–Genetic Approach to Hydraulic Fracture Treatment Design and Optimization," Society of Petroleum Engineers Paper No. 36602, SPE Annual Technical Conference & Exhibition, Denver, CO. (Oct. 1996).

Shahab Mohaghegh, M. Hugh Hefner, and Sam Ameri: "Fracture Optimization eXpert (FOX)—How Computational Intelligence Helps the Bottom–Line in Gas Storage; A Case Study," Society of Petroleum Engineers Paper No. 37341, SPE Eastern Regional Conference, Columbus, OH (Oct. 1996).

Nikravesh, M., et al.; "Dividing Oil Fields into Regions with Similar Characteristic Behavior Using Neural Network and Fuzzy Logic Approaches", Fuzzy Information Processing Society, 1996, NAFIPS., 1996 Biennial Conference of the North American, held 19–22, Jun. 1996.

Tsai, Wu–Yuan, et al.; "An ART2–BP Neural Net and Its Application to Reservoir Engineering", Neural Networks, 1994. IEEE World Congress on Computational Intelligence., 1994 IEEE Conference on, held Jun. 2—Jul. 2, 1994, pp. 3289–3294 vol. 5. Jun. 1994.

Wong, P.M., et al., "An Improved Technique in Porosity Prediction: A Neural Network Approach", Geoscience and Remote Sensing, IEEE Transaction on, vol. 33, Iss. 4, Jul. 1995, pp. 971–980.

*Primary Examiner*—Donald E. McElheny, Jr.
*Attorney, Agent, or Firm*—Stephen R. Christian; E. Harrison Gilbert, III

[57] ABSTRACT

A method controlling development of an oil or gas reservoir uses a neural network and genetic algorithm program to define a neural network topology and the optimal inputs for that topology. The topology is defined from identified and selected (1) parameters associated with the formation or formations in which actual wells are drilled in the reservoir and (2) parameters associated with the drilling, completion and stimulation of those wells and (3) parameters associated with the oil or gas production from the wells. Subsequent drilling, completion and stimulation of the reservoir is determined and applied based on hypothetical alternatives input to the topology and resulting outputs.

12 Claims, 4 Drawing Sheets

METHOD OF CONTROLLING DEVELOPMENT OF AN OIL OR GAS RESERVOIR

BACKGROUND OF THE INVENTION

This invention relates generally to the management of oil or gas reservoirs and more particularly to a method of controlling the development of such a reservoir.

An oil or gas reservoir is a zone in the earth that contains, or is thought to contain, one or more sources of oil or gas. When such a reservoir is found, typically one or more wells are drilled into the earth to tap into the source(s) of oil or gas for producing them to the surface.

The art and science of managing oil or gas reservoirs has progressed over the years. Various techniques have been used for trying to determine if sufficient oil or gas is in a given reservoir to warrant drilling, and if so, how best to develop the reservoir to produce any oil or gas that is actually found.

One technique has simply used human experience. Individuals have become skilled in studying data obtained from a given reservoir and then applying their experience to make determinations about the given reservoir and how, if at all, to develop it.

Computer modeling techniques have more recently been used. Previous types of reservoir models have been based on linear mathematical analyses using only a few input parameters (e.g., two or three parameters such as reservoir quality, location, treatment rate, etc.). More recently, neural network modeling of reservoirs has been used. Neural network modeling is advantageous because it can develop correlations between a relatively large number of input parameters and one or more output parameters that would be difficult if not impossible to obtain using linear mathematical techniques.

Neural network techniques have been applied to predicting the production from gas storage reservoirs after training the network on previously drilled and treated wells. This prior neural network development has relied on a human expert designing the neural topology or correlation between inputs and outputs and selecting the optimal inputs for the topology. Even using an expert, there is much educated trial and error effort spent finding a desired topology and corresponding optimal inputs. This is time consuming and expensive and must typically be done for each different reservoir, and it requires a highly skilled human expert to provide useful results.

The ability to more quickly and less expensively analyze a reservoir by whatever means is becoming more and more important. Companies that provide goods and services for use in developing oil or gas reservoirs are basing major business decisions on entire reservoir analysis rather than just individual wells for which they may be hired for a particular job. Because these decisions need to be made quickly as opportunities present themselves, there is the need for an improved method of analyzing oil or gas reservoirs and particularly for controlling the subsequent development of reservoirs that appear to be favorable for oil or gas production.

SUMMARY OF THE INVENTION

The present invention overcomes the above-noted and other shortcomings of the prior art by providing a novel and improved method of controlling the development of an oil or gas reservoir. The present invention utilizes neural network technology so that multiple input parameters can be used for determining a meaningful correlation with a desired output, but the present invention further automates this process to overcome the deficiencies in the prior expert, trial-and-error neural network technique. In particular, the present invention uses genetic algorithms to define the neural network topology and corresponding optimal inputs.

Advantages of the present invention include the ability to create a model of a given reservoir more quickly and less expensively than the aforementioned techniques. The present invention can be used to optimize production from an oil or gas reservoir per dollar spent on stimulation as opposed to simply determining a maximum possible production which may or may not be obtainable most cost effectively. By optimizing production per stimulation dollar, the customer can get the highest return on investment. The present invention can also be used in determining whether development of a reservoir should be pursued (and thus whether a service company, for example, should bid on a job pertaining to that reservoir). The present invention is also advantageous in determining how many and where wells should be drilled in the reservoir, in designing optimum systems for completing or treating wells (e.g., gravel packing, perforating, acidizing, fracturing, etc.), and in evaluating performance.

The method of controlling development of an oil or gas reservoir in accordance with the present invention can be defined as comprising steps of:

(a) selecting an oil or gas reservoir, wherein the reservoir has a plurality of wells drilled therein from which oil or gas has been produced;

(b) identifying well drilling parameters associated with drilling of the plurality of wells;

(c) identifying well completion parameters associated with completing the plurality of wells;

(d) identifying well stimulation parameters associated with stimulating the plurality of wells;

(e) identifying formation parameters associated with the locations in the reservoir where the plurality of wells are drilled;

(f) identifying production parameters associated with the production of the oil or gas from the plurality of wells;

(g) selecting at least one drilling parameter, at least one completion parameter, at least one stimulation parameter, at least one formation parameter, and at least one production parameter from among the identified well drilling parameters, well completion parameters, well stimulation parameters, formation parameters, and production parameters;

(h) converting the selected parameters to encoded digital signals for a computer;

(i) defining in the computer a neural network topology representing a relationship between the selected drilling, completion, stimulation and formation parameters and the at least one selected production parameter in response to the encoded digital signals, including manipulating the encoded digital signals in the computer using genetic algorithms to define the neural network topology;

(j) entering into the computer as inputs to the defined neural network topology a first group of additional encoded digital signals representing proposed drilling, completion, stimulation and formation parameters of the same type as the selected drilling, completion, stimulation and formation parameters, and generating an output from the defined neural network topology in response;

(k) repeating step (j) using at least a second group of additional encoded digital signals representing other proposed drilling, completion, stimulation and formation parameters; and (l) controlling further development of the oil or gas reservoir in response to at least one of the generated outputs, including at least one step selected from the group consisting of (1) drilling at least one new well in the reservoir in response to the generated output and (2) treating at least one well in the reservoir in response to the generated output.

The present invention can also be defined as a method of generating a model of an oil or gas reservoir in a digital computer for use in analyzing the reservoir. This comprises providing the computer with a data base for a plurality of wells actually drilled in the reservoir, including parameters of physical attributes of the wells; providing the computer with a neural network and genetic algorithm application program to define a neural network topology within the computer in response to the parameters in the data base; and initiating the computer such that the neural network and genetic algorithms within the application program automatically define the neural network topology and the input data used to optimally form the topology in response to the data base of the parameters of physical attributes of the wells. This method can further comprise: determining a hypothetical set of parameters of physical attributes corresponding to at least some of the physical attribute parameters of the data base; providing the computer with the determined hypothetical set of parameters; calculating in the computer, using the defined neural network topology, a production parameter correlated to the hypothetical set of parameters; and operating a display device in response to the calculated production parameter so that an individual viewing the display device tracks possible production from a well to which the hypothetical set of parameters is applied prior to any actual corresponding production occurring. The method can additionally comprise drilling an actual well in the reservoir in response to the display of possible production. It can still further comprise: determining additional data and providing the additional data to the data base of the computer, including measuring and recording actual parameters of physical attributes of the actual well drilled in the reservoir; and initiating the computer such that the neural network and genetic algorithm application program automatically operates within the computer to redefine the neural network topology in response to the data base of parameters of physical attributes of the wells, which data base includes the additional data.

The resultant trained network can then be used as a fit function for another genetic algorithm program to allow the optimization of the input parameters that can be changed. These changeable parameters are any but the reservoir parameters since the reservoir parameters are fixed if the well is drilled in a specific location. The reservoir parameters can also be optimized by using the neural network and genetic algorithm to select the location that should have the reservoir parameters which should optimize final production.

Therefore, from the foregoing, it is a general object of the present invention to provide a novel and improved method of controlling development of an oil or gas reservoir. Other and further objects, features and advantages of the present invention will be readily apparent to those skilled in the art when the following description of the preferred embodiments is read in conjunction with the accompanying drawings.

DETAILED DESCRIPTION OF THE INVENTION

With the present invention, one can analyze an oil or gas reservoir, determine if it is worth pursuing, and if it is, how to further develop it. Such further management includes drilling additional wells, reworking existing wells in the reservoir, or performing new treating or stimulation procedures. Specific drilling information that can be derived from the present invention includes where to drill and how or what type of drilling to perform, and examples of particular treating or stimulation procedures that can result from the present invention include particular types of perforating, acidizing, fracturing or gravel packing procedures. Thus, the present invention provides a method of controlling development of an oil or gas reservoir. In particular, it is a computer-implemented method of controlling development of an oil or gas reservoir by enabling an individual to observe through the operation of the computer a simulated production of oil or gas from the reservoir before an actual well is drilled in the reservoir to try to obtain therefrom actual production corresponding to the simulated production. As part of this, the present invention includes a method of generating a model of an oil or gas reservoir in a digital computer for use in analyzing the reservoir.

Figure 1:
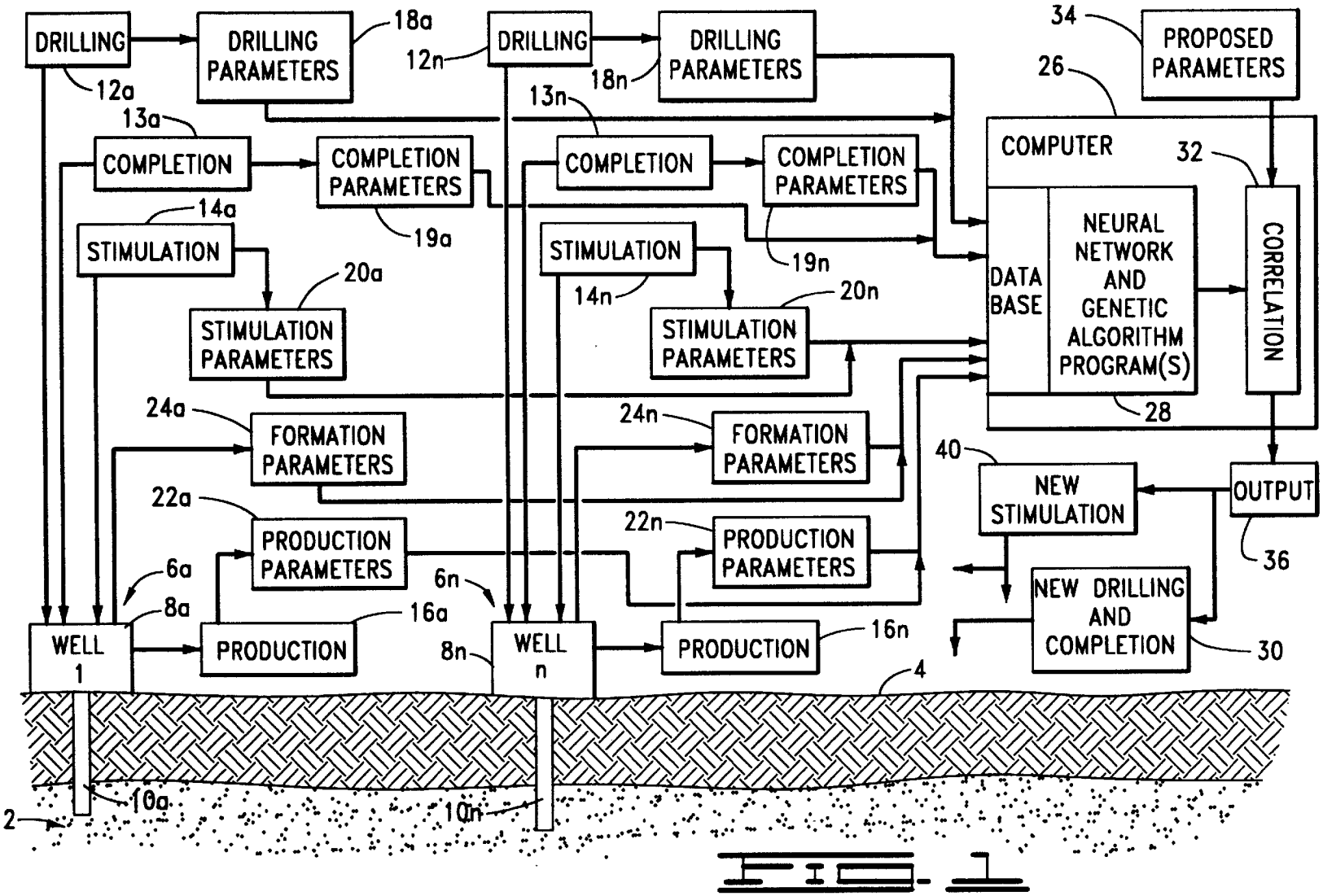
FIG. 1 is a block diagram and pictorial illustration representing an oil or gas reservoir having a plurality of wells with which the present invention is used.

The present invention is typically applied to a specific selected reservoir; however, particular results obtained with regard to one reservoir might be useful as at least a starting point for the analysis of another reservoir which has not begun to be developed and thus from which specific types of data may not be available. Once such data are available, then the method of the present invention could be used with regard to that specific reservoir. Accordingly, FIG. 1 shows the method pertaining to a subterranean reservoir 2 containing one or more deposits of oil or gas. The reservoir 2 is located beneath the earth's surface 4 through which a plurality of wells 6*a*–6*n* have been drilled. Each of the wells 6 has conventional wellhead equipment 8 at the surface 4, and each well 6 has downhole equipment 10 which penetrates the earth and communicates with one or more oil-bearing or gas-bearing formations or zones of the reservoir 2. The wells 6 are existing, actual wells from which oil or gas production has been obtained.

FIG. 1 shows that each of the wells 6 has been drilled by a suitable drilling process 12. Examples include rotary bit drilling with liquid drilling fluids and air drilling. Some type of completion process 13 (e.g., cementing, perforating, etc.) has been performed on each well. Additionally, each well is shown to have had some type of stimulation process 14 applied to it. Examples include stimulation with a proppant laden fluid having a base fluid of a linear gel, cross linked gel, foam or any other suitable fluid. The stimulation fluid can also be an acid or any other existing or future stimulation fluid or process designed for enhancing the production from a well. As a result of the foregoing, production 16 was obtained from the respective wells. Respectively associated with or derived from each drilling 12, completion 13, stimulation 14 and production 16 are respective drilling parameters 18, completion parameters 19, stimulation parameters 20, and production parameters 22. In addition to parameters 18, 19, 20, 22, there are also formation parameters 24 which define characteristics regarding the subterranean earth and structure and reservoir 2. More generally, there are well implementation parameters (which include parameters 18, 19, 20 and 24 in the preferred embodiment) and well production parameters (parameters 22 for the above). The specific values of the production parameters for a given well are to some degree or another the result of the specific values or implementations of the well implementation parameters, and it is the determination of this relationship that is one aspect of the present invention.

Examples of drilling parameters 18 pertinent to the present inventions include but are not limited to the following: type of drilling, drilling fluid, days to drill, drilling company, time of year drilling started and completed, and day and year drilling completed. These drilling parameters are obtained from the drilling records maintained on each well by the well's operating company.

Examples of completion parameters 19 pertinent to the present invention include but are not limited to the following: number of perforations, size of perforations, orientation of perforations, perforations per foot, depth of top and bottom of perforations, casing size, and tubing size. These parameters can be obtained from the operating company's records of how the well was completed. In some instances this information can be verified by well logs.

Examples of stimulation parameters 20 pertinent to the present inventions include but are not limited to the following: base fluid type, pad volume, pad rate, treating volume, treating rate, proppant type, proppant size, proppant volume, proppant concentration, gas volume for foam fluids, foam quality, type of gas, acid type and concentration, acid volume, average acid injection rate, day and year of treatment, and service company performing treatment. Of the above parameters, the following information is obtained from the operating company's or service company's job treatment ticket: base fluid type, proppant type, proppant size, type of gas, acid type and concentration, day and year of treatment, and service company performing treatment. The other above-listed stimulation parameters are obtained by measuring instruments (flowmeters, densometers, etc.) which are on the flowlines and transmit the information back to a computer which records the information real-time throughout the job. These values are then provided by the service company to the operating company in the form of a job report or ticket. These values are then taken from the job report or ticket and manually entered into a data base of pertinent information for treating the reservoir.

Examples of formation parameters 24 pertinent to the present invention include but are not limited to the following: porosity, permeability, shut in bottom hole pressure, depth of top of pay zone, depth of bottom of pay zone, latitude, longitude, surface altitude, zone, and reservoir quality. The porosity, permeability, depth of the top and bottom of pay zone and zone are determined directly by well logging. The shut in bottom hole pressure is a measured parameter. The latitude, longitude and surface altitude are obtained from surveying records showing the location of the well on the earth's surface. The reservoir quality is a calculated value particular to different areas. An example would be a reservoir quality calculated from (permeability) *(total feet of pay zone)*((shut in bottom hole pressure)^2).

Examples of production parameters 22 pertinent to the present invention include but are not limited to the following: day and year of start of production, six month cumulative gas and/or oil production, and twelve month cumulative gas and/or oil production. This information is obtained from the operating company's records or from a company such as Dwight's that maintains data bases on oil and gas production.

Of the parameters that are identified or available with regard to any particular drilling 12, completion 13, stimulation 14, production 16 or formation, certain ones are selected manually or by the genetic algorithms as desired to input into a computer 26 of the present invention. The parameters that are selected are provided as encoded electrical signals either as taken directly from the sensing devices used in the aforementioned operations or by converting them into appropriate encoded electrical signals (e.g., translation of a numeral or letter into a corresponding encoded electrical signal such as by entering the numeral or letter through a keyboard of the computer 26). These signals are stored in the memory of the computer 26 such that the encoded electrical signals representing the parameters from a respective well are associated for use in the computer 26 as subsequently described. This provides to the computer 26 a data base of the plurality of parameters for the plurality of wells 6 actually drilled in the reservoir 2.

The computer 26 is of any suitable type capable of performing the neural network operations of the present invention. This typically includes a computer of the 386–25 MHz type or larger. Specific models of suitable computers include IBM ValuePoint model 100dx4 and Dell 75 MHz Pentium.

Examples of suitable operating systems with which a selected computer should be programmed for running particular known types of application programs referred to below include: Windows 3.1, Windows 95, and Windows NT. Software is also available that will run on UNIX, DOS, OS2/2.1 and Macintosh System 7.x operating systems.

The computer 26 is programmed with a neural and genetic application program 28. The neural section allows the training of topologies selected by the genetic portion of the program. The neural and genetic program is any suitable type, but the following are examples of specific programs: NeuroGenetic Optimizer by BioComp Systems, Inc., Neuralyst by Cheshire Engineering Corporation, and BrainMaker Genetic Training Option by California Scientific Software. The same results could be achieved by using separate neural network software and genetic algorithm software and then linking them in the computer. An example of these separate software programs is NeuroShell 2 neural net software and GeneHunter genetic algorithm software by Ward Systems Group, Inc. The particular implementation of the program(s) 28 operates with the aforementioned data base of the computer 26.

Once the selected parameters are in the data base in the computer 26, and the neural and genetic program 28 is provided in the computer 26, operation of computer 26 is initiated such that the application program 28 automatically selects through the genetic algorithms, the inputs which have substantial impact on the well production and the corresponding topology which yields a predicted production that most nearly matches the actual measured production. This neural network topology represents the correlation or relationship between the selected drilling, completion, well stimulation and formation parameters and the at least one selected production parameter. These parameters are manipulated in their encoded digital signal format in the computer using the genetic algorithms to define the neural network topology.

The following process is used to obtain and train the networks in a particular implementation. First, the data base is organized in a comma delimited format (*.csv) with the outputs in the far right columns. Next, the NeuroGenetic Optimizer (NGO) program is started. The NGO is set to operate in the function approximation mode. Next, the number of outputs in the data base to be matched are selected. The data file (*.csv) is selected. After selecting the data file, the NGO separates the data into a train and a test data group. The default for this selection places 50% of the data in the train data group and 50% in the test data group. These groups are selected such that the means of the train and test data groups are within a user specified number of standard deviations of the complete data set. This automated splitting saves many hours of manual labor attempting to come up with statistically valid splits by hand.

Neural parameters are selected next. A selection of a limit on the number of neurons in a hidden layer places boundaries on the search region of the genetic algorithm. Hidden layers can be limited to 1 or 2. The smaller number narrows the search region of the genetic algorithm. The types of transfer functions (hyperbolic tangent, logistic, or linear) can be set for the hidden layers. The above three transfer functions will automatically be used for the search region for the output layer if the system is not limited only to linear outputs. The linear output limit is selected to allow better predictions outside the data space of the original training data. "Optimizing" neural training mode is selected to activate the genetic algorithms. Neural training parameters are set such that the system will look at all data at least twenty times with a maximum passes setting of one hundred and a limit to stop training if thirty passes occur without finding a new best accuracy. A variable learning rate (0.8 to 0.1) and variable momentum (0.6 to 0.1) are suitable for this system. These variable rates operate such that, for example, the learning rate would be 0.8 on the first pass and 0.1 on the one hundredth pass if the maximum passes is set at one hundred. Next, the genetic parameters are set. The population size is set at thirty and a selection mode is set such that fifty percent of the population yielding a neural topology and selected input parameters having the greatest impact with that topology will survive to be used as the breeding stock for the next generation. The mating technique selected is a tail swap with the remaining population refilled by cloning. A mutation rate of 0.25 is used.

Next the system parameters are set. For this application the "average absolute accuracy" is selected for determining the accuracy of each topology examined by the NGO algorithms. The system is set to stop optimizing when either fifty generations have passed in the genetic algorithm or when an "average absolute error" of "0.0" is reached for one of the topologies.

The system is now set to run. While running, the system will train on the training data set and test the error on the test data set. This will determine the validity of each topology tested since the system will not see the test data set during training, only after the topology is trained with the training data. As the system continues to run, the ten topologies with the best accuracies are saved for further analysis. When the system has reached the fiftieth generation or the population convergence factor stops improving, the ten best topologies are examined. The best topologies are again run but this time the maximum passes is changed to three hundred. This allows each topology to be trained to its maximum capability as some of the original ten best will have still been improving in accuracy when the one hundred passes was reached. Typically, the topology with the simplest form and highest accuracy is selected.

When satisfied with a particular topology, then this topology can be used as a fit function in another genetic algorithm program (e.g., GeneHunter sold by Ward Systems Group, Inc.). This arrangement allows the full optimization of site selection, drilling, completion, reservoir, and stimulation parameters to provide the optimum conditions to maximize the production from a reservoir.

The above-mentioned method has advantages over conventional methods because the conventional methods would use a human expert to either manually or with some other software or method attempt to split the data set in representative train and test sets. As mentioned previously, this process can take many hours if done manually where using a neural-genetic process to provide the split takes a matter of seconds. Conventional means also require the expert to determine which of the input data has the greatest impact on the prediction accuracy along with using an educated trial and error (trial and guess) method for determining which topology to try next. This, too, is time consuming; but in the present invention the use of genetics to make the selection reduces the solution to a matter of minutes or hours depending on the size and number of inputs and outputs for the data set and the size of the topologies examined.

As a result of the foregoing, the neural network topology, or correlation, is created and resides within the computer 26 as designated by the box 32 shown in FIG. 1. In actuality, the correlation 32 is not something distinct from the programs 28, 30 but is an internal result of weighting functions or matrix which is applied when new parameters are input. For example, after the neural topology is defined, an add-in to NGO is Penney which provides an Application Programming Interface (API) that can be used to develop Excel based applications. NGO also provides the weight functions in matrix format such that the matrices can be included in any application program written for analyzing a particular reservoir.

Once the correlation 32 has been defined, specific values or implementations of additional parameters 34 of the same types as the drilling parameters 18, completion parameters 19, stimulation parameters 20 and formation parameters 24 can be input into the computer 26 for use by the correlation 32 in generating an output 36 defining a resultant production parameter or parameters. Proposed parameters 34 can be one or more groups of additional encoded digital signals representing proposed drilling, completion, well stimulation and formation parameters of the same type as the selected drilling, completion, well stimulation and formation parameters 18, 19, 20, 24. These typically pertain to a proposed well that might be drilled and/or treated in accordance with a respective additional, hypothetical set of parameters 34. The output 36 simulates a production from such a proposed well. A representation of the simulated production output 36 is displayed for observation by an individual, such as through a monitor of the computer 26. This display can be alphanumerical or graphical as representing a flow from a depicted well. Through operation of the display device in response to the output 36, an individual viewing the display device tracks possible production from a well to which a group from the hypothetical set of parameters 34 is applied prior to any actual corresponding production occurring.

From the output 36, further development of the oil or gas reservoir is controlled. This includes either new drilling and completion 38 or new stimulation 40 (on new or old wells). If new drilling occurs, the output 36 can be used in selecting a location to drill the well in the reservoir 2 as determined from the corresponding group or set of input proposed parameters 34. The output 36 can also be used in forming a stimulation fluid and pumping the stimulation fluid into the well in response to the generated output 36 as also determined from the corresponding group or set of input proposed parameters 34. That is, once the desired output is obtained from the aforementioned hypothetical input and resultant output process using the correlation 32, the parameters of the corresponding input set are used to locate, drill, complete and/or stimulate. For example, the input set of parameters may contain location information to specify where a new well is to be drilled in the reservoir; or the input set may contain stimulation fluid parameters and pumping parameters that designate the composition of an actual fluid to be formed and the rate or rates at which it is to be pumped into a well, which fluid fabrication and pumping would occur using known techniques.

One way to obtain the foregoing is to use the correlation 32 to select a job that falls in the median range for all wells treated in the reservoir. Next, each of the parameters is varied and input to the neural network to determine how sensitive the reservoir is to each parameter. This is the approach of Examples 1–3 given below.

Another approach is as follows. After the best neural topology is determined using the NGO (for the specific implementation referred to above), the neural network is used as a fit function to a genetic algorithm which holds the reservoir parameters fixed and optimizes the treatment for each set of reservoir parameters. This optimization can be on maximum production, maximum production per dollar spent on stimulation, maximum production per dollar spent on well from drilling through production, etc. Another neural net is trained with NGO which predicts the well parameters from latitude and longitude. Next, the genetic algorithm is used to find the optimum latitude, longitude and treating parameters to maximize production. The reservoir parameters are fixed to the values predicted by the second neural network for each input of latitude and longitude. The result of this process is the optimal location to drill a new well along with how to drill, complete and stimulate. This is only one method with many others possible. If the well is already drilled and completed, only the optimization of production with treating parameters is performed.

Further development of the oil or gas reservoir can also be controlled in the following manner. This includes computing a cost for implementing the proposed drilling, completion, stimulation and formation parameters of the proposed parameters 34 as used in performing the new drilling and completion 38 or the new stimulation 40. This further includes computing a revenue for the projected production of each of the generated outputs 36. A ratio of the revenue to costs is then determined and the generated output 36 having the highest ratio is selected as the output to use in the further development of the reservoir when it is desired to try to maximize the production per dollar invested in obtaining the production. These steps are used when two or more groups of proposed parameters 34 are used with the correlation 32 to generate respective outputs 36.

The method of the present invention can further comprise initiating the computer 26 such that the neural-genetic program 28 automatically operates within the computer 26 to redefine the neural network topology (i.e., the correlation 32). This is performed in response to the data base of parameters with which the original correlation was defined and with additional data that have been measured and recorded with regard to the actual wells drilled or stimulated with the new drilling and completion 38 or new stimulation 40 procedures. Thus, as additional data is obtained during the further development of the reservoir 2, the correlation 32 can be refined.

The following are examples for a particular implementation of the present invention.

EXAMPLE 1

The present invention was used with a group of forty wells in the Cleveland formation in the Texas panhandle. A quantitative trend result representing the output 36 in FIG. 1 was obtained in two days after identification and selection of the following parameters: completion date, frac date, stimulation fluid type, total clean fluid, carbon dioxide amount, total proppant, maximum proppant concentration, average injection rate, permeability, average porosity, shut-in bottom hole pressure, formation quality, net height of pay zone, and middle of the perforated interval. The last six of the foregoing parameters are referred to as formation parameters and are not variable for a particular well because they are fixed by the formation itself. The other parameters, referred to as surface parameters which encompass the drilling, completion and stimulation parameters 12, 13, 14, can be changed for subsequent wells; however, in defining a particular neural network topology, these parameters are fixed by what was actually done at the wells used in creating the topology.

Figure 2:
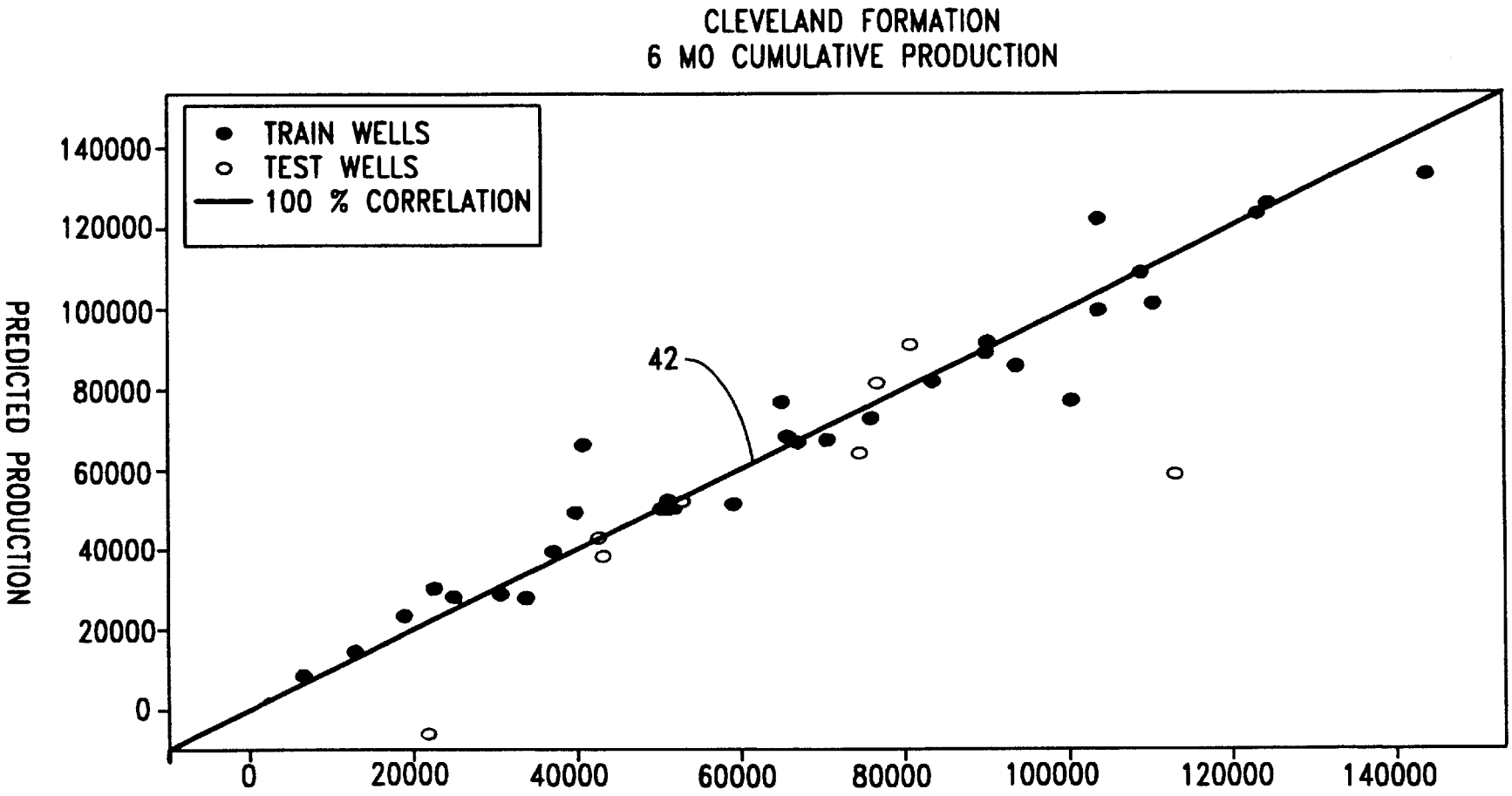
FIG. 2 is a graph showing a comparison between actual production and predicted production for a specific reservoir to which the present invention was applied.

The graph of FIG. 2 shows the accuracy of the correlation 32 derived for the forty wells in the Cleveland formation. Twenty percent (i.e., eight) of the wells were removed from the data set before obtaining the correlation. For a one hundred percent correlation, all data would lie on diagonal line 42 in FIG. 2. The thirty-two solid circles designate the predicted versus actual production for the thirty-two wells used to train the neural network to create the correlation. After the correlation was obtained, the corresponding parameters for the eight wells originally removed from the data set were input as the proposed parameters 34 to test the correlation to predict the production on wells the system had never seen. The actual versus predicted production parameters for these eight wells are designated in FIG. 2 by the hollow circles.

EXAMPLE 2

Figure 3:
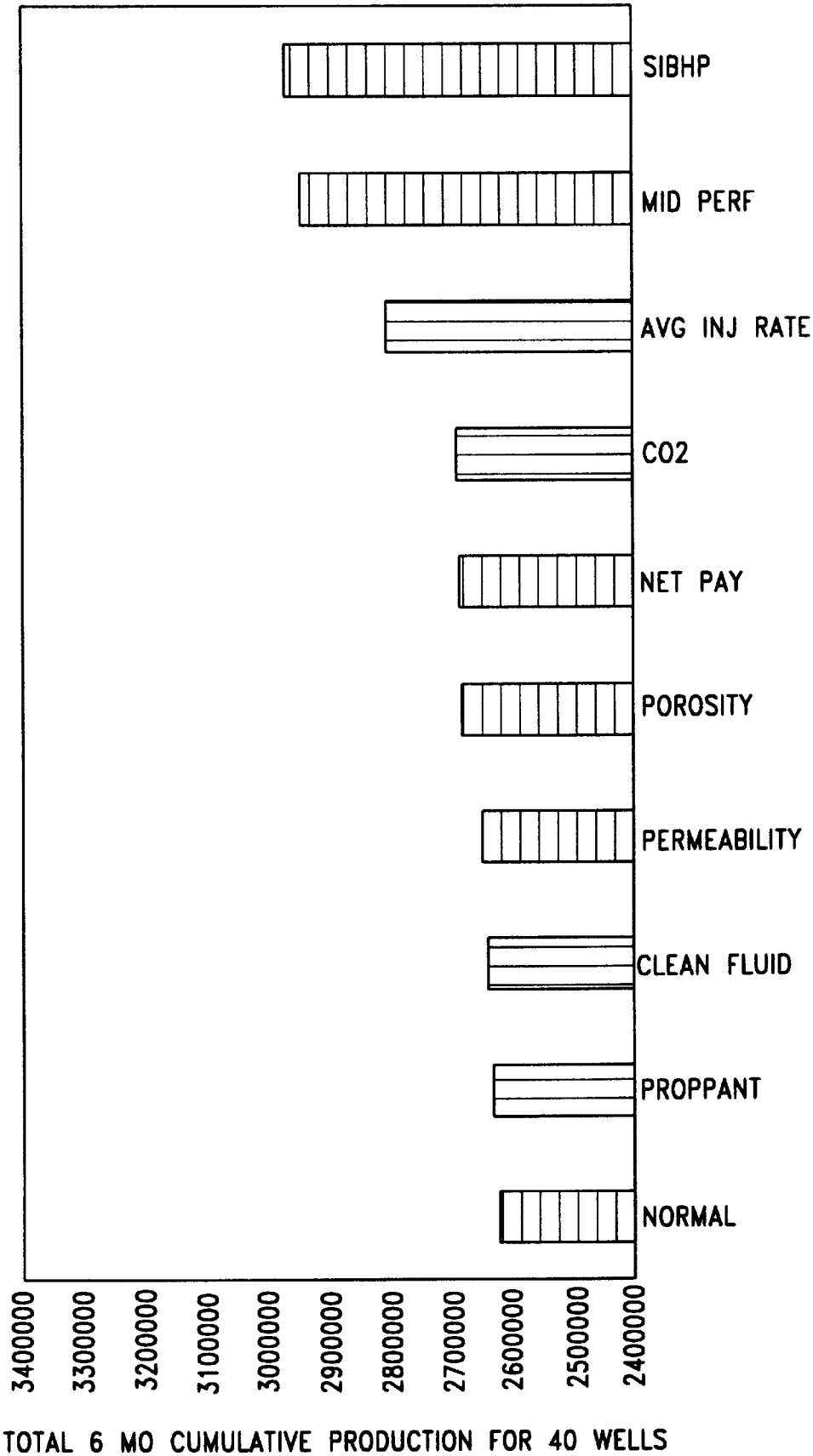
FIG. 3 is a graph showing a sensitivity analysis when different parameters were varied for wells in the reservoir of FIG. 2. The base parameters that were varied were from the wells as treated.

The method of the present invention was also used to test for parameter sensitivity. Having a model of the reservoir allows various parameters to be changed to determine the sensitivity of the reservoir to changes in the parameters. All bars with vertical interior lines shown in FIG. 3 are for surface parameters which can be changed by the operator, and the bars with horizontal interior lines are for the parameters fixed by the formation. Although for a specific application the formation parameters are fixed, for purposes of testing effects of changes in parameters, the formation parameters designated in FIG. 3 were changed by ten percent. This analysis left all wells as originally treated and varied one parameter at a time. Each of the bars to the right of the "normal bar" (which represents the sum of the six-month cumulative productions of all forty wells referred to in Example 1) shows the potential change in production by a ten percent variation of the parameter associated with the respective bar in the graph of FIG. 3. For example, to produce the bar above "proppant" in FIG. 3, all parameters recorded from the way the wells were treated and the formation parameters were left at their as-treated values while the quantity of proppant was changed by ten percent. With all other parameters constant and the proppant quantities changed by ten percent, this new set of data was run through the neural network and the predicted productions from all wells were summed to get the cumulative production. This new cumulative production obtained by changing only the proppant by ten percent was plotted as a bar above the word "proppant." The same procedure was used to vary each of the other listed parameters one at a time. The graph of FIG. 3 shows the greatest change results from the variation of the shut-in bottom hole pressure parameter.

EXAMPLE 3

To be able to determine parameter sensitivities to various fluid treatment types, the same type sensitivity analysis was done but with regard to a standardized job with only the fluid type being different. The parameters of the standard job were as follows:

Proppant 200,000 pounds

Clean Fluid 60,000 gallons $CO_2$ 100 Tons (0 if not foam)

Average Injection Rate 55 barrels per minute

Maximum Proppant Concentration 68.5 parts per gallon

Figure 4:
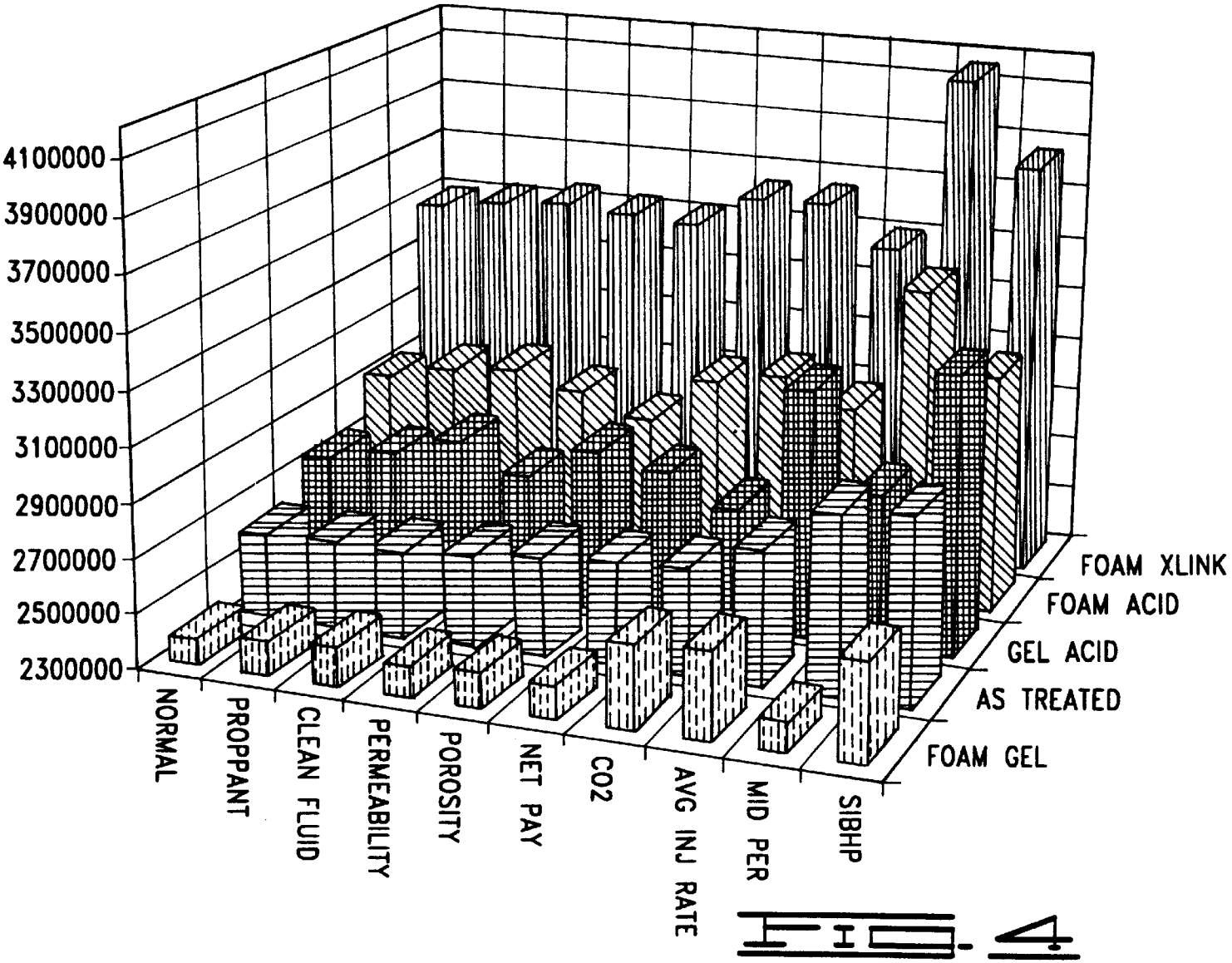
FIG. 4 is a graph showing the sensitivity analysis of the reservoir of FIG. 2 when all wells are stimulated with the same treatment. These treatment parameters are varied. The formation parameters were also varied to show which formation parameter had the greatest effect on production in this particular application.

Referring to FIG. 4, the second row of bars marked "as treated" in this graph correspond to the sensitivity analyses shown in FIG. 3. The other bars show the sensitivity analyses for each fluid type using the above standard treatment. The foam gel treatments show to be inferior to the other treatments including the "as treated group." The gel acid and foam acid show to be better than the as treated. The foam cross-link treatments were the best in the analysis but the validity of this may be questioned due to not having a sufficiently large sample of foam cross-link jobs (there were only four wells treated with a foam cross-link treatment in the original data set used to form the model). If the four-well sample is significantly correct, then there is room for drastic improvement in production using a foam cross-link fluid in this reservoir.

The following chart shows whether the individual parameters in Examples 2 and 3 were increased (+) or decreased (−) to achieve an increase in the production:

| | AS TREATED | FOAM GEL | GEL ACID | FOAM ACID | FOAM XLINK |
|---|---|---|---|---|---|
| NORMAL | 0 | 0 | 0 | 0 | 0 |
| PROPPANT | + | + | − | + | + |
| CLEAN FLUID | − | − | − | + | + |
| PERMEABILITY | + | + | + | + | + |
| POROSITY | + | + | + | + | + |
| NET PAY | + | + | + | + | + |
| CO2 | + | + | 0 | + | + |
| AVG INJ RATE | + | + | + | − | +* |
| MID PERF | − | − | − | − | − |
| SIBHP | + | + | + | + | + |

NOTE:
*Peak occurred at 60 bpm. Above or below showed drop. Therefore, max increases seen with nine percent increase of avg inj rate for this fluid.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of controlling development of an oil or gas reservoir, comprising steps of:

(a) selecting an oil or gas reservoir, wherein the reservoir has a plurality of wells drilled therein from which oil or gas has been produced;

(b) identifying well drilling parameters associated with drilling of the plurality of wells;

(c) identifying well completion parameters associated with completing the plurality of wells;

(d) identifying well stimulation parameters associated with stimulating the plurality of wells;

(e) identifying formation parameters associated with the locations in the reservoir where the plurality of wells are drilled;

(f) identifying production parameters associated with the production of the oil or gas from the plurality of wells;

(g) selecting at least one drilling parameter, at least one completion parameter, at least one stimulation parameter, at least one formation parameter, and at least one production parameter from among the identified well drilling parameters, well completion parameters, well stimulation parameters, formation parameters, and production parameters;

(h) converting the selected parameters to encoded digital signals for a computer;

(i) defining in the computer a neural network topology representing a relationship between the selected drilling, completion, stimulation and formation parameters and the at least one selected production parameter in response to the encoded digital signals, including manipulating the encoded digital signals in the computer using genetic algorithms to define the neural network topology;

(j) entering into the computer as inputs to the defined neural network topology a first group of additional encoded digital signals representing proposed drilling, completion, stimulation and formation parameters of the same type as the selected drilling, completion, stimulation, and formation parameters, and generating an output from the defined neural network topology in response;

(k) repeating step (j) using at least a second group of additional encoded digital signals representing other proposed drilling, completion, stimulation and formation parameters; and (l) controlling further development of the oil or gas reservoir in response to at least one of the generated outputs, including at least one step selected from the group consisting of (1) drilling at least one new well in the reservoir in response to the generated output and (2) treating at least one well in the reservoir in response to the generated output.

2. A method as defined in claim 1, wherein the step of drilling at least one new well in the reservoir includes selecting a location to drill the well in the reservoir in response to the generated output.

3. A method as defined in claim 1, wherein the step of treating at least one well includes forming a stimulation fluid and pumping the stimulation fluid into the well in response to the generated output.

4. A method as defined in claim 1, wherein step (l) further includes computing a cost for implementing the proposed drilling, well stimulation and formation parameters represented by the respective encoded digital signals of each group in steps (j) and (k); computing a revenue for each of the generated outputs; and selecting the generated output having the highest computed revenue to corresponding computed cost ratio as the generated output in response to which the further development of the reservoir is controlled.

5. A computer-implemented method of controlling development of an oil or gas reservoir by enabling an individual to observe through the operation of the computer a simulated production of oil or gas from the reservoir before an actual well is drilled in the reservoir to try to obtain therefrom actual production corresponding to the simulated production, said method comprising:

(a) selecting an oil or gas reservoir having a known configuration of equipment disposed therein defining a plurality of actual wells drilled in the reservoir and further having a plurality of known well implementation parameters and well production parameters for each of the actual wells;

(b) simulating each of the actual wells in the computer, including translating selected ones of the known parameters of the actual wells into encoded electrical signals for the computer and storing the encoded electrical signals in memory of the computer such that the encoded electrical signals representing the selected well implementation parameters for a respective actual well are associated with the encoded electrical signals representing the selected production parameters for the same respective well;

(c) determining with the computer a correlation for the reservoir between the types of the selected well implementation parameters and the types of production parameters in response to the plurality of simulated wells, including creating in the computer a neural network topology defining the correlation using predetermined genetic algorithms and the stored encoded electrical signals;

(d) indicating to the computer a proposed well for the reservoir, including translating well implementation parameters for the proposed well into encoded electrical signals and storing the encoded electrical signals in the computer;

(e) simulating with the computer a production from the proposed well, including generating an output representing the production in response to the encoded electrical signals of step (d) and the correlation of step (c) such that the generated output is correlated to the encoded electrical signals of step (d) by the correlation of step (c); and (f) displaying for observation by an individual a representation of the simulated production.

6. A method as defined in claim 5, further comprising drilling an actual well in the reservoir based on the well implementation parameters of step (d), including selecting a location to drill the well in the reservoir in response to the displayed representation of the simulated production.

7. A method as defined in claim 6, further comprising treating the drilled well, including forming a stimulation fluid and pumping the stimulation fluid into the well in response to the well implementation parameters of step (d).

8. A method as defined in claim 5, further comprising:

repeating steps (d), (e) and (f) for a plurality of simulated proposed wells;

computing a cost for implementing the proposed well implementation parameters for each of the plurality of simulated proposed wells, and computing a revenue for each of the simulated productions for the proposed wells; and drilling an actual well in the reservoir corresponding to the simulated proposed well having the highest ratio of computed revenue to corresponding computed cost.

9. A method of generating a model of an oil or gas reservoir in a digital computer for use in analyzing the reservoir, comprising:

providing the computer with a data base for a plurality of wells actually drilled in the reservoir, including parameters of physical attributes of the wells;

providing the computer with a neural network and genetic algorithm application program to define a neural network topology within the computer in response to the parameters in the data base; and initiating the computer such that the neural network and genetic algorithms within the application program automatically define the neural network topology and the input data used to optimally form the topology in response to the data base of the parameters of physical attributes of the wells.

10. A method as defined in claim 9, further comprising:

determining a hypothetical set of parameters of physical attributes corresponding to at least some of the physical attribute parameters of the data base;

providing the computer with the determined hypothetical set of parameters;

calculating in the computer, using the defined neural network topology, a production parameter correlated to the hypothetical set of parameters; and operating a display device in response to the calculated production parameter so that an individual viewing the display device tracks possible production from a well to which the hypothetical set of parameters is applied prior to any actual corresponding production occurring.

11. A method as defined in claim 10, further comprising drilling an actual well in the reservoir in response to the display of possible production.

12. A method as defined in claim 11, further comprising:

determining additional data and providing the additional data to the data base of the computer, including measuring and recording actual parameters of physical attributes of the actual well drilled in the reservoir; and initiating the computer such that the neural network and genetic algorithm application program automatically operates within the computer to redefine the neural network topology in response to the data base of parameters of physical attributes of the wells, which data base includes the additional data.

* * * * *